US005201024A

United States Patent [19]

Steffes

[11] Patent Number: 5,201,024

[45] Date of Patent: Apr. 6, 1993

[54] DOUBLE LOOP HEAT STORAGE SPACE HEATING FURNACE USING AN AIR-TO-AIR HEAT EXCHANGER

[76] Inventor: Paul J. Steffes, 1282 Fairway, Dickinson, N. Dak. 58601

[21] Appl. No.: 618,267

[22] Filed: Nov. 26, 1990

[51] Int. Cl.[5] ..... F24H 7/00; F24D 11/00; F28D 20/00

[52] U.S. Cl. ..... 392/344; 126/400; 165/18; 165/165; 219/530; 392/360; 392/496

[58] Field of Search ..... 392/339-346, 392/496, 360; 219/530, 540; 126/400; 165/165, 18

[56] References Cited

U.S. PATENT DOCUMENTS

| | | | |
|---|---|---|---|
| 1,758,474 | 5/1930 | Seehaus | 392/346 X |
| 1,892,211 | 12/1932 | Hopkins | 392/344 |
| 1,979,083 | 10/1934 | Singer | 392/346 X |
| 2,019,351 | 10/1935 | Lathrop | 165/165 |
| 2,856,506 | 10/1958 | Telkes . | |
| 2,911,513 | 11/1959 | MacCracken | 392/346 X |
| 3,301,251 | 1/1967 | Jackson . | |
| 3,381,113 | 4/1968 | Jacques et al. . | |
| 3,382,917 | 5/1968 | Rice | 392/341 X |
| 3,885,126 | 5/1975 | Sugiyama et al. . | |
| 3,975,620 | 8/1976 | Hallgreen et al. . | |
| 3,989,927 | 11/1976 | Erb . | |
| 4,006,734 | 2/1977 | Eadie et al. . | |
| 4,012,920 | 3/1977 | Kirschbaum . | |
| 4,042,012 | 8/1977 | Perry et al. . | |
| 4,094,302 | 6/1978 | Rohr . | |
| 4,097,719 | 6/1978 | Olsen et al. . | |
| 4,200,783 | 4/1980 | Ehret | 392/346 X |
| 4,234,782 | 11/1980 | Barabas et al. . | |
| 4,631,388 | 12/1986 | Manning . | |
| 4,714,821 | 12/1987 | Jakobsson . | |

FOREIGN PATENT DOCUMENTS

| | | | |
|---|---|---|---|
| 657973 | 2/1963 | Canada . | |
| 1138911 | 7/1957 | Fed. Rep. of Germany . | |
| 1812747 | 8/1969 | Fed. Rep. of Germany | 392/344 |
| 3442085 | 5/1986 | Fed. Rep. of Germany . | |
| 914075 | 3/1945 | France . | |
| 1322119 | 2/1963 | France | 392/357 |
| 2310535 | 6/1975 | France . | |
| 63-105362 | 5/1988 | Japan | 392/344 |
| 63-105363 | 5/1988 | Japan | 392/344 |
| 42973 | 4/1965 | Sweden . | |
| 984992 | 11/1965 | United Kingdom . | |
| 1026245 | 4/1966 | United Kingdom . | |
| 1064378 | 9/1967 | United Kingdom . | |
| 1071781 | 11/1967 | United Kingdom . | |
| 1273602 | 12/1970 | United Kingdom . | |
| 1238854 | 1/1971 | United Kingdom . | |

OTHER PUBLICATIONS

"ETS News" Summer 1989.

*Primary Examiner*—Anthony Bartis
*Attorney, Agent, or Firm*—Palmatier & Sjoquist

[57] ABSTRACT

A double loop heat storage space heating furnace has a housing with an upper heat storage section containing an electrically heated heat storage brick portion and a lower section containing an air-to-air heat exchanger having first and second air flow passages. The furnace has two separate flow courses. The first flow course uses a room air fan to circulate room air through the first passages of the heat exchanger. The second flow course has a recirculating fan in the lower housing section for recirculating air in a continuous closed loop through the heat storage brick portion to be heated and the second flow passages of the heat exchanger so that heat is delivered from the heated recirculated air and the room air in the heat exchanger. The upper housing section includes a cooling air space surrounding the heat storage brick portion through which the room air fan circulates a portion of the room air to maintain the furnace housing at a temperature similar to that of the room air.

9 Claims, 3 Drawing Sheets

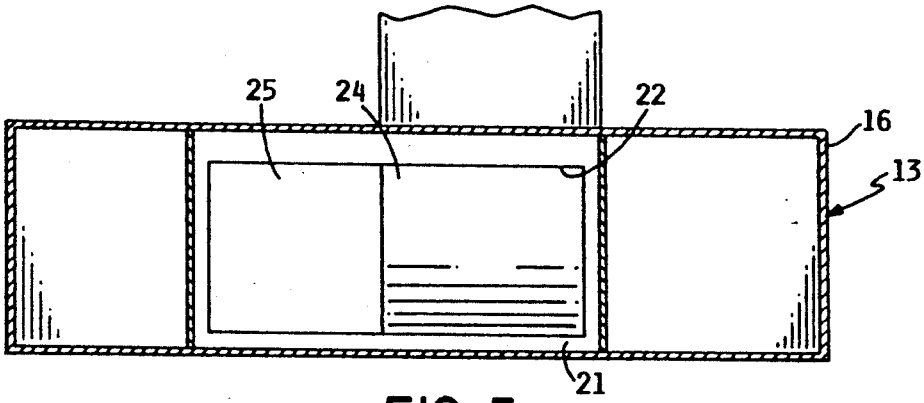
FIG. 5
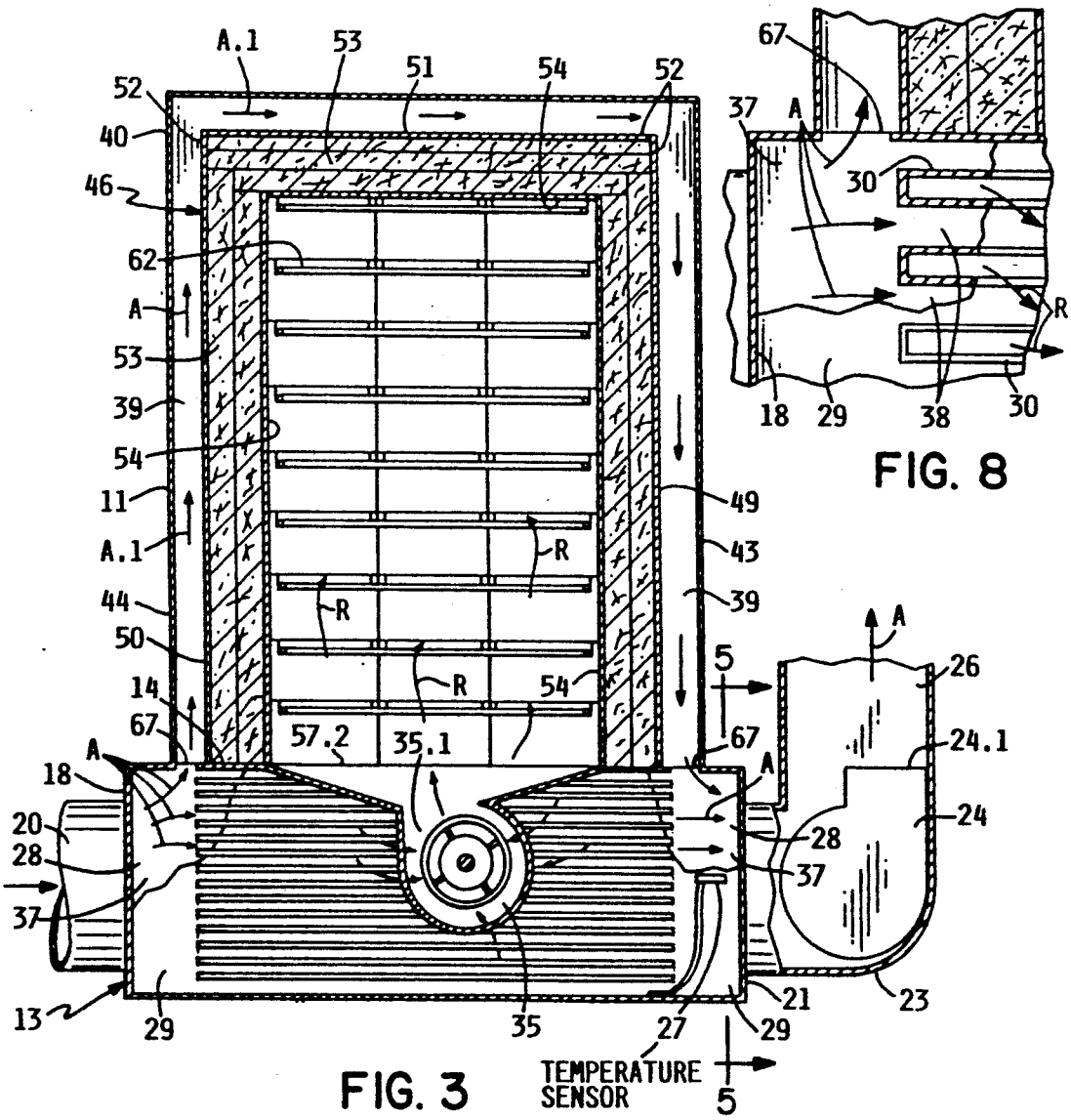
FIG. 8
FIG. 3

DOUBLE LOOP HEAT STORAGE SPACE HEATING FURNACE USING AN AIR-TO-AIR HEAT EXCHANGER

BACKGROUND OF THE INVENTION

Space heating furnaces have been known previously and are useful for heating structures, particularly where the source of the heat is electrical energy. Frequently, space heating furnaces will contain heat storage units which are chargeable during "off peak" hours of electricity demand, in order to take advantage of lower electrical energy expenses. These space heating furnaces are then able to generate a sufficient volume of heat to satisfactorily charge the heat storage units at an economical cost to the individuals. Subsequently, during peak demand hours during which high rates are charged for energy, room air is moved through the furnace to be heated, and thus returned to the room for space heating.

When room air is moved through a furnace and heated the quality of the heated room air may be diminished due to odors which occur as a result hydrocarbon "cracking." Hydrocarbon "cracking" occurs when air is exposed to extreme temperatures. Odors will exist when room air is directly exposed to an extreme heat source and then recirculated back into a structure.

One form of space heating furnace is disclosed in the Barabas, et al. U.S. Pat. No. 4,234,782 which illustrates the use of "off peak" electricity to heat alkaline metal or alkaline earth metal salts which are used as a heat storage device. Heating of a structure occurs with the circulation of room air through the heat storage device and then back into the structure.

The Manning U.S. Pat. No. 4,631,388 shows another form of heating system which illustrates the use of "off peak" electricity to heat a stack of bricks which are thermally connected to a vessel containing a liquid to be heated by a controllable heat pipe.

Other forms of space heat furnaces and heat storing devices are illustrated in U.S. Pat. Nos. 4,714,821, 4,006,734, 4,094,302, and 3,381,113.

SUMMARY OF THE INVENTION

The present invention is a space heating furnace which provides heated room air to a structure for the comfort of individuals.

An object and advantage of the invention is to provide a heat storing furnace capable of heating room air without adversely affecting the quality of the air.

Another object of the invention is the provision of a new and improved heat storing furnace of relatively simple and inexpensive construction and operation and which is safe to have and use without fear of damage to property and/or injury to persons coming near it.

The furnace accomplishes the first object by establishing a recirculating air flow course, separate from the room air flow course of the space heating furnace, and producing a heat exchange therebetween.

A feature of the invention is a closed loop air passage for recirculating heated air through the furnace heat source and not allowing the recirculated air to be disseminated into the room spaces being heated.

Another feature of the invention is the relationship between the recirculating air flow course, the room air flow course, and the heat exchanger providing the means for the transfer of heat from the closed loop air passage to the room air circulating in a structure.

Still another feature of the invention is the electrically charged heating medium which is charged during off peak hours, and discharged during peak hours, serving as the source of energy, without changing the quality of the air circulated through the spaces being heated.

Still another feature of the invention is a solid heat storage medium which operates to store and transfer heat continuously to the recirculating air flow course, over an extended period of time, after termination of the supply of electrical energy to the heating medium.

BRIEF DESCRIPTION OF THE DRAWINGS

FIG. 3 is a section view taken approximately at 3—3 of FIG. 2.

FIG. 5 is a detail section view taken approximately at 5—5 of FIG. 3.

FIG. 8 is an enlarged detail section view partly broken away for clarity of detail.

DETAILED DESCRIPTION OF THE PREFERRED EMBODIMENT

Figure 2:
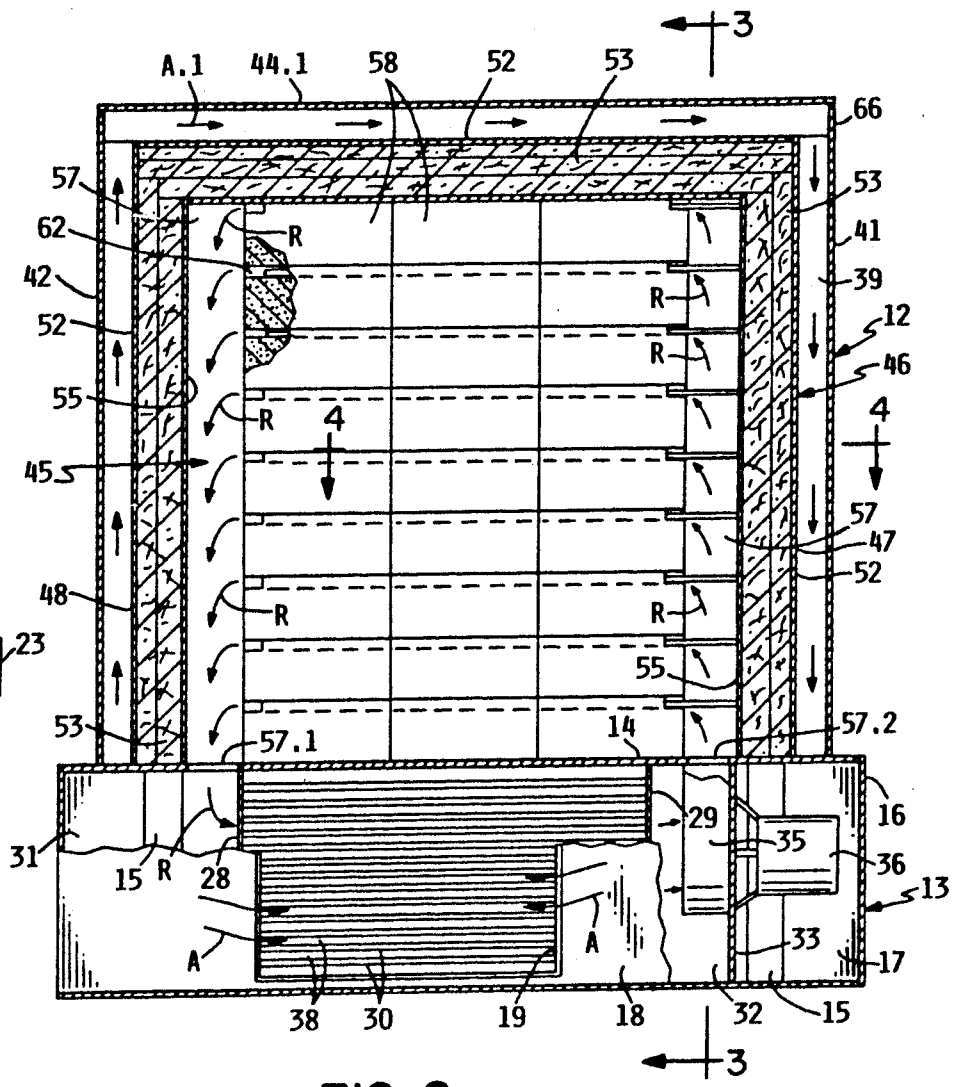
FIG. 2 is an elevation view taken approximately at 2—2 in FIG. 1 with substantial portions broken away and shown in section for clarity of detail.
Figure 1:
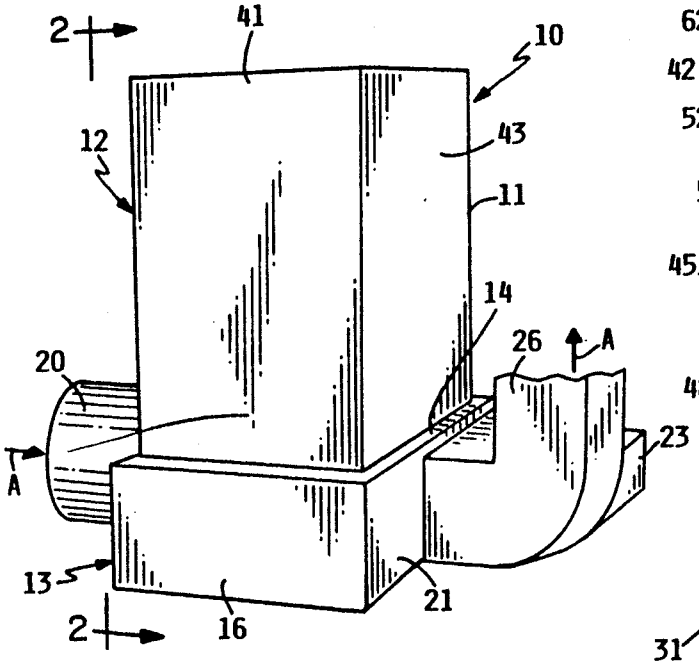
FIG. 1 is a perspective view of the furnace incorporating the invention.

One form of the invention is illustrated and described herein. The space heating furnace is indicated in general by the numeral 10. The housing of the furnace is indicated in general by numeral 11 and has an upper section 12 and a lower section 13. The upper and lower sections 12 and 13 are separated by a structural deck 14 which may be insulated and which is supported by upright corner legs 15. The front panel 16 of the lower portion of the housing is preferably attached to the remainder of the housing as by screws and brackets so as to be removable to obtain access into the chamber 17 where a number of controls may be mounted.

The side panel 18 of the lower portion has an access opening 19 therein and is connected to a return air duct 20 for supplying room air into the furnace to be heated.

The opposite side panel 21 of the lower section 13 of the furnace has an outlet opening 22 therein communicating with a fan housing 23 enclosing the room air fan 24, and its motor, and the housing 23 also encloses a plenum area 25 through which room air is supplied into the intake of the fan 24. The housing 23 also connects the outlet 24.1 of the fan to the duct system 26 of the room or building to be heated for delivering the reheated room air to the spaces. The arrows indicating flow of the room air are indicated by the letter A. A temperature sensor or thermistor 27 is mounted in the lower housing portion immediately adjacent the access port 22 from the housing into the fan plenum 25.

Figure 7:
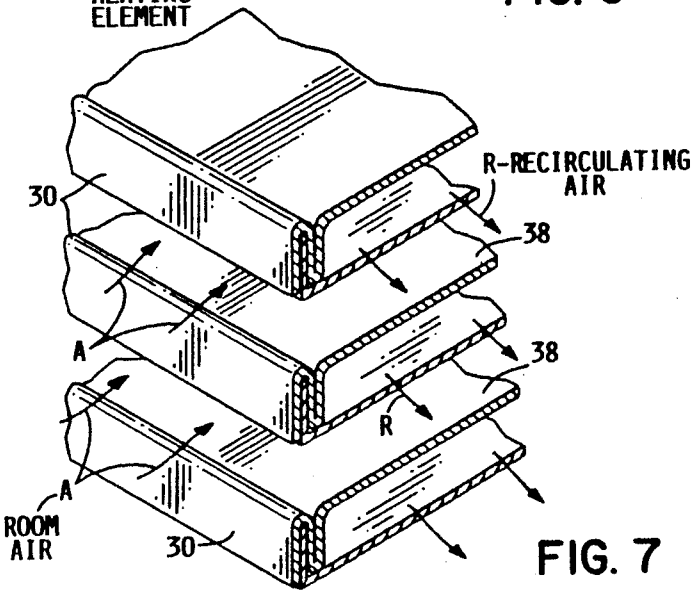
FIG. 7 is a detail perspective view of a portion of the heat exchanger.

The lower portion 13 of the housing also contains a pair of panels 28 and 29 which extend entirely from sidewall 18 to sidewall 21. The panels 28 and 29 mount the opposite ends of a multiplicity of heat exchanger tubes 30, the ends of which open through the panels 28, 29 for the purpose of receiving and passing heated recirculated air indicated by the arrows R from the plenum area 31, and discharging the recirculated air R through the panel 29 into the plenum area 32. The heat exchanger tubes 30 are spaced from each other as seen in FIGS. 7 and 8 so that the room air A will pass between the heat exchanger tubes 30 in passages 38 while the recirculating air is flowing through the tubes as indicated by the arrows R in FIGS. 7 and 8.

The lower portion 13 of the housing is also divided by a panel 33 which extends entirely from the side panel 18 to the side panel 21 so as to entirely close off the plenum area 32 from the chamber 17 which may contain controls for the furnace. Suitable vents may be provided in the panel 16 to maintain the temperatures in the chamber 17 at nearly room temperature.

Panel 33 also serves to mount the fan 35 for the recirculating air R, and mounts the fan motor 36 as well.

It will be recognized that the plenum space 37 between panels 28 and 29 and below the deck 14 defines the main flow passage for the room air A flowing from the return duct 20 to the fan 24. The flow passages 38 between the heat exchanger tubes 30 accommodate the flow of the room air and it is in these passages 38 where the heat exchange takes place and the room air is reheated from the heated recirculating air R which is passing through the heat exchanger tubes 30.

The heat exchanger tubes are preferably formed of aluminized steel to withstand high temperatures of the recirculated air as hereinafter described.

The return air duct 20, the plenum area 37, which confines the heat exchanger defined by tubes 30, and the fan 24 together with its adjacent plenum area 25, together define the room air flow course for this furnace. A small portion of the room air also circulates through the upper portion 12 of the housing as indicated by arrows A.1 in a space 39 immediately inside the outer skin or sheath 40 of the upper portion 12 of the housing. The room air accesses space 39 from plenum 37 via flow ports 67 formed in deck 14. The upper portion 12 of the housing has front and back panels 41 and 42 respectively, side panels 43 and 44, and top panel 44.1, all of which are preferably formed of galvanized steel.

A heat storage chamber 45 is defined by an insulated wall structure indicated in general by numeral 46 which has front and back walls 47 and 48 and sidewalls 49 and 50 interconnected securely with each other to provide heat insulation and sealing around the entire chamber 45. The top wall 51 is also connected with the front and back and sidewalls as to seal and insulate the insulated chamber 45. Each of the front, back, side and top walls 47–51 are similarly constructed and have galvanized steel panels 52 at their exterior sides adjacent to the open space 39. Each of the front, back, side and top walls has a number of layers of ceramic fibre insulation 53; and it may be desirable to incorporate an extra layer or batt of ceramic fibre insulation in the top wall 51 and in certain instances in the front wall 46. At the inner surface of the sidewalls 49, 50, and of the top wall 51, panels 54 of aluminized steel lie flush against the ceramic fibre insulation to entirely close and seal these walls. The two front and back walls 47 and 48 have stainless steel inner panels 55 with offset portions 56, giving the panel a generally corrugated shape as to define a plurality of open air flow spaces or passages 57 immediately adjacent the front and back walls 47, 48 at their inner side. Flow passages 57 communicate with plenum 31 at an opening 57.1 in deck 14; and with the discharge opening 35.1 of fan 35 at another opening 57.2 in deck 14.

Figure 6:
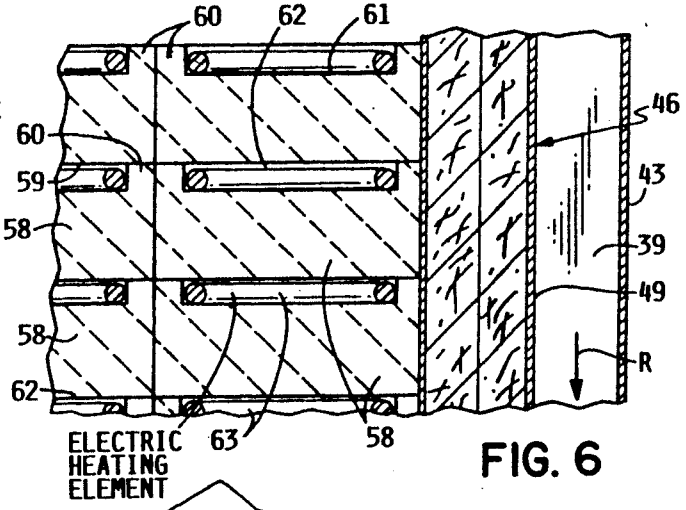
FIG. 6 is a detail section view taken approximately at 6—6 of FIG. 4.

The insulated chamber 45 confines a multiplicity of heat storing bricks arranged in a number of courses, each course including, in this embodiment, nine bricks arranged three in a row and three rows. The heat storing bricks are made of finely ground magnetite ($FE_3O_4$) pressed together and including a binder, preferably a white plastic clay, a natural product. The clay may include a small quantity of bentonite and also a small quantity of lubricant such as talc. In any event, the bricks are solid and primarily made of magnetite which has substantial heat storing capabilities. Each of the bricks has a flat bottom 59 and has a pair of longitudinally extending, narrow ribs 60 extending along opposite sides of the brick and protruding upwardly from the top surface 61 of the brick which is spaced downwardly from the top surfaces of the ribs 60. Accordingly, as best seen in FIGS. 3 and 6, there is a flow passage 62 above each brick and beneath the brick above. Of course, the flow passages 62 permit flow of the recirculating air R from the fan 35 and through the array or assembly of bricks.

A multiplicity of heat producing resistance heating rods, lay on the several courses of bricks in the flow passages 62. The heating rods are serpentine shape as to be formed around the ribs 60 and to lay upon the upper faces 61 of the bricks. It will be recognized that the U-shaped bights 64 of the heating rods are confined entirely between the confronting faces of adjacent bricks so that whenever electrical energy is supplied to the heating rods and heating occurs, the heat from the rods will be absorbed by the heat storing bricks.

Figure 4:
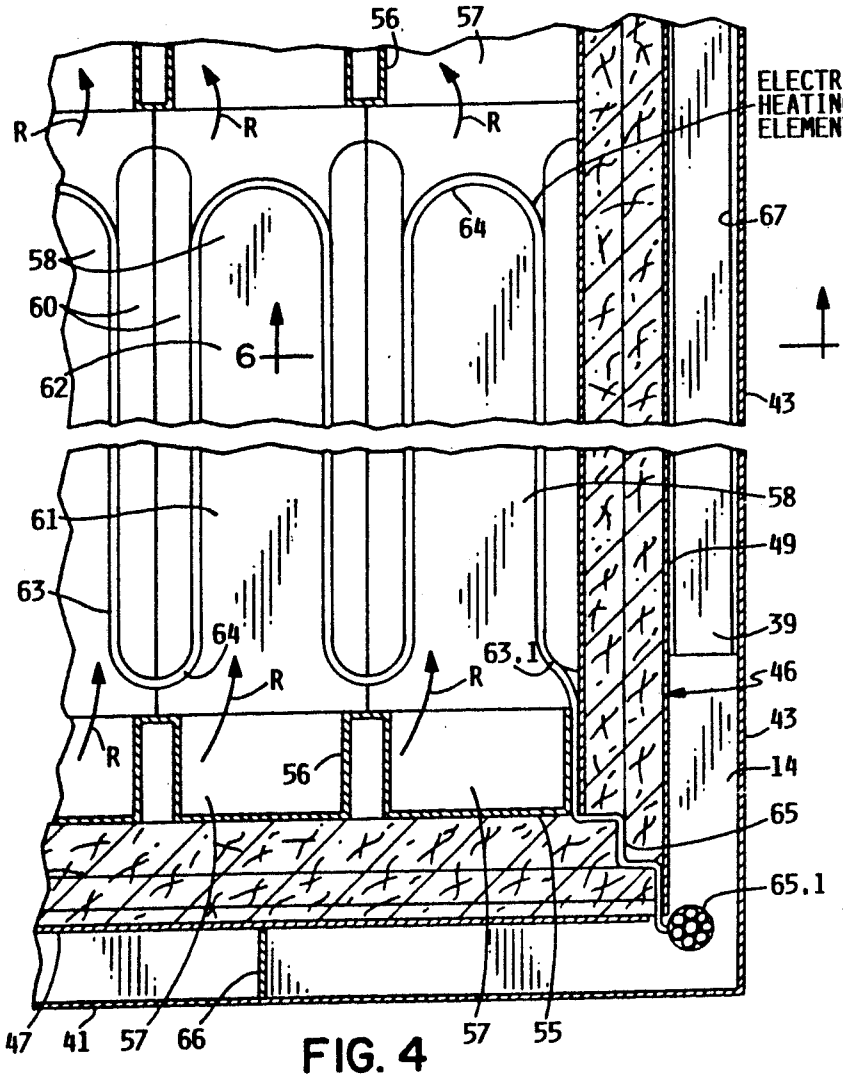
FIG. 4 is en enlarged detail section view taken approximately at 4—4 of FIG. 2.

The end portions 63.1, of the heating rods as seen in FIG. 4 are connected to a low resistance electrical conductor 65 which supplies electrical current and energy to the resistance heater heating rods 63. The conductors 65 are clustered together as at 65.1 in the room air flow space 39 at the exterior of the insulated wall 46.

Between the insulated chamber wall 46 and the outer skin or sheath 43 of the upper portion 12 of the housing, an air flow guiding divider panel 66 is provided which extends entirely from the deck 14 to the top of the front wall of the panel 47 and also to the top of the back wall panel 48. The panels 66 in the spaces 39 require the room air flowing in the space 39 to flow up and over the top of the insulated wall 46, and prevent the room air from simply shunting around the insulated wall 46 in a general horizontal direction.

As seen in FIGS. 3 and 4, the deck 14 has slot shaped ports 67 formed therein between the space 39 and the plenum 37 as to receive a small portion of the room air, under the influence of the fan 24.

In this furnace 10, in addition to the room air flow course described previously, there is the recirculating air flow course for heating air, the heat from which will be transferred to the room air. The recirculating air flow course includes the insulated wall 46 around the bricks 58, the heating rods 63 for heating the air, the flow passages 62 through which the air flows to absorb air from the heat storing bricks, the air flow passages 57 which deliver recirculating air upwardly and downwardly adjacent the ends of the bricks, and the fan 35 which draws the air from plenum chamber 32 and chamber 31 through the heat exchanger tubes 30. The furnace may have thermostatic controls incorporated into it so as to cause heat to be available in such quantities as may be expected to be needed.

The heating rods 63 may heat the bricks into the temperature ranges of up to approximately 1,350° F. under various cool conditions. For instance the bricks 58 will be heated during night time hours when electrical energy is readily available and inexpensive. During these off peak hours, the bricks will be heated, without recirculating the air R so as to simply store substantial heat in the bricks for use during the peak hours of electrical energy during the day time hours. If ambient temperatures are in the range of 35° to 50° F., heat may be supplied by the heating rods into the bricks into the range of 500° F. or possibly plus or minus 100° of that level. It is ordinarily expected that if the bricks are heated to that level during off peak hours, there will be enough heat during the next daytime hours to heat the spaces needed to be heated. Similarly, if ambient temperature ranges are in the range of 15° to 35° F. approximately two-thirds of a full charge will be supplied to the bricks so that they will obtain a temperature in the range of 950° F., plus or minus 100°. This amount of heat stored will ordinarily provide adequate heat for the spaces to be heated during the next peaks hours.

In the event temperatures fall below 15° F., heat is stored in the bricks to a full charges, up to approximately 1,350° F., for about one million BTUs; and this should be approximately enough heat to supply adequate heat for heating spaces during the next peak hours when the electricity is not to be used.

When a thermostat in the spaces to be heated calls for heat, the fan 35 will be turned on, as will the fan 24. The fan 35 will commence circulating the recirculation air R through the passages 62 between the bricks 58 for heating the air, and then the recirculating air moves downward adjacent the backside of the furnace through the passage 57 and plenum 31 and into the heat exchanger tubes 30 as illustrated in FIG. 2. As the recirculating air passes through the heat exchanger tubes, the heat is extracted from the air and the temperature of the recirculating air is materially reduced until the recirculating air is drawn through the fan 35 at a temperature well below 400° F. The recirculating air is then propelled upwardly through the passage 57 by the fan 35 and will recirculate through the passages between the several layers of bricks to be reheated again.

As the recirculating air progressively moves the heat from the bricks downwardly with the recirculated air into the heat exchanger, the room air is being drawn through the return air duct 20 by the fan 24 which draws the return room air through the plenum 31 and then through the passages 38 between the air ducts 30, substantially as seen in FIG. 7. As the room air passes through the spaces between the heat exchanger tubes 30, the room air is heated and will be drawn through the fan 24 and then discharged through the duct system 26 into the spaces to be heated. Air moved by the fan 24 and through the heat exchanger and into the room air ducts 26 will not exceed a temperature of 200° F., accordingly, there is not deterioration of the air. In the event that excessive air temperatures are experienced at the thermistor 27 at the inlet to the fan 24, the control system will shut down the fan 35 until acceptable temperatures are again experienced.

It will be seen that this invention provides a space heating furnace utilizing a heat that is generated electrically during off peak hours and then stored for use during other hours of the day. The furnace utilized magnetite bricks to store the heat to temperatures up to nearly 1,400° F. Air is recirculated through and over the bricks when heat is to be extracted from the furnace and the air circulated over the bricks is confined and not allowed to escape into the room or spaces to be heated. This recirculated air is passed through a heat exchanger and then returned to the recirculating air flow course to again pick up heat and deliver the heat to the heat exchanger. The room air flow course from the return air duct 20 to the heating air duct 26, includes portions of the heat exchanger to receive heat from the recirculating air flowing in the heat tubes. A small portion of the room air is shunted around the heat exchanger and flows through the space immediately inside the skin of the upper portion of the housing to withdraw whatever heat is available there and to be drawn by the fan 24 along with the air that is passed through the spaces 38 of the heat exchanger.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A space heating furnace comprising a housing having a lower section and an upper section above the lower section, a room air flow course portion for supplying air into the space to be heated and comprising a room air fan, a recirculating air flow course portion providing a heat source portion for the room air, said recirculating air flow course portion comprising an electrically heated heat storage brick portion and heating the recirculating air at least into the range of 500° F. plus or minus 100° F. to 1350° F. and also comprising a recirculating air fan, a heat exchanger portion connected into both of said flow course portions and transferring heat from the recirculating air to the room air, said fans moving both room air and recirculating air through the heat exchanger portion, said lower section of the housing confining said room air flow course portion and said heat exchanger portion, said upper portion of the housing confining said heat storage brick portion, said recirculating air flow course portion traversing both of said upper and lower sections, said upper section of the housing comprising an outer sheet metal sheath portion embracing and spaced outwardly from the heat storage brick portion and defining a cooling air space between the sheath portion and the brick portion, said room air flow course portions having continuously open access ports into the cooling air space for moving a portion of such room air through the cooling space and for cooling the sheath portion.

2. A space heating furnace according to claim 1 wherein the heat exchanger portion comprises opposite sides in the room air flow course portion, said access ports being adjacent opposite sides of the heat exchanger portion to divert room air through the cooling air space.

3. A space heating furnace according to claim 1 wherein said upper section of the housing also comprises divider panels in said cooling air space and between said access ports for diverting air flow within the cooling space.

4. A space heating furnace according to claim 1 wherein said heat storage brick portion heats the recirculating air into the range of 900° F. plus or minus 100° F.

5. A space heating furnace according to claim 1 wherein said heat storage brick portion heats the recirculating air into the range of 1350° F.

6. A space heating furnace according to claim 1 wherein the recirculating air flow course portion also comprises a panel comprising opposite side portions respectively facing toward and away from the flowing recirculating air, said recirculating air fan being adjacent to the side portion of the panel facing toward the flowing recirculating air, whereby to propel the flowing air, and a motor driving the fan and located at the side portion of the panel facing away from the flowing recirculating air.

7. A space heating furnace according to claim 1 wherein the heat exchange portion comprises opposite inlet and outlet side portions in the recirculating air flow course portion, the inlet side portion receiving heated recirculating air from the heat storage brick portion, the outlet side portion of the heat exchanger portion discharging recirculating air after heat has been removed from the recirculating air at the heat exchanger portion, said recirculating air fan being located in said recirculating air flow course portion adjacent the outlet side portion of the heat exchanger portion.

8. A space heating furnace according to claim 1 wherein the recirculating air flow course portion in the upper section of the housing also comprises an insulating wall portion spaced from and enclosing the heat storage brick portion to define recirculating air flow passages and also comprising panel portions between the insulating wall portion and the brick portion.

9. A space heating furnace according to claim 8 wherein the panel portions have offset portions traversing the air flow passages and directing recirculating air toward and away from the heat storage brick portion.

* * * * *